US006203423B1

(12) United States Patent
Craw et al.

(10) Patent No.: US 6,203,423 B1
(45) Date of Patent: Mar. 20, 2001

(54) DAMPER FLAP AND DUCT CONNECTOR ASSEMBLY

(75) Inventors: Gary J. Craw, Delafield; Daniel L. Karst, Beaver Dam, both of WI (US)

(73) Assignee: Broan Manufacturing Company, Inc., Hartford, WI (US)

( * ) Notice: Subject to any disclaimer, the term of this patent is extended or adjusted under 35 U.S.C. 154(b) by 0 days.

(21) Appl. No.: 09/371,287

(22) Filed: Aug. 10, 1999

(51) Int. Cl.[7] ..... F24F 7/00
(52) U.S. Cl. ..... 454/359; 454/259
(58) Field of Search ..... 454/359; 137/527, 137/527.6, 527.8; 16/386, 372

(56) References Cited

U.S. PATENT DOCUMENTS 625,443 * 5/1899 Glover ..... 16/386
4,114,238 * 9/1978 Powell ..... 16/157

* cited by examiner

*Primary Examiner*—Harold Joyce
*Assistant Examiner*—Derek S. Boles
(74) *Attorney, Agent, or Firm*—Michael Best & Friedrich LLP

(57) ABSTRACT

A damper flap and duct connector assembly for controlling air flow through a ventilation system includes a damper flap pivotably mounted to a duct connector. The connector connected to a ventilator has an air flow opening disposed in its center and a cylindrical ring extending from the outer edge that is connected to a ventilation duct. The connector also includes a pair of spaced, opposed brackets disposed above one edge of the air flow opening. The damper flap includes a generally rectangular plate forming the body of the flap that rests over the air flow opening in the connector to selectively open and close the opening, and a pair of arms extending outwardly from one edge of the plate. The arms are rolled towards the plate to form a pair of mounting tubes separated by a flexible portion of the plate. The length between opposite ends of the tubes is longer than the length between the opposed brackets. Due to the ability of the plate to flex, this distance may be shortened to allow the sleeves to be inserted into mounting openings in the brackets to pivotably retain the damper flap on the connector.

10 Claims, 2 Drawing Sheets

DAMPER FLAP AND DUCT CONNECTOR ASSEMBLY

FIELD OF THE INVENTION

The present invention relates to ventilators used in building ventilation systems, and more specifically to an improved damper flap and duct connector assembly for use with such a ventilator.

BACKGROUND OF THE INVENTION

In order to control the temperature and air quality, in commercial and other buildings, building ventilation systems are utilized. These ventilation systems include a number of exhaust ventilators spaced throughout the building to withdraw air from the rooms in the building. Removal of the air from a room allows a separate heating and/or air conditioning system in the building to supply air to the room to effectively control the temperature.

The ventilators connected to the ventilation system are normally located directly above the ceiling of the room so that the ventilator can withdraw air from the room by means of a fan or blower mounted in the ventilator. After the air is drawn into the ventilator by the fan, the air is then discharged from the ventilator through an outlet opening in the ventilator housing. The outlet opening is connected to a ventilation duct by a duct connector at the outlet opening disposed in the ventilator housing. The ventilation duct leads from the ventilator to the exterior the building, allowing the air removed by the ventilator to be vented to the outside atmosphere.

As the duct connects the ventilator with the outside atmosphere, it is desirable to prevent air from the outside atmosphere from flowing through the ducts into the ventilator and back into the room from which the air was removed.

To this end, a damper flap is placed in duct or duct connector that opens to allow air flowing from the ventilator freely into the duct, but closes to block the passage of air flowing in the reverse direction from the outside atmosphere to the ventilator. A common damper flap construction comprises a flat plate that is hinged to the duct connector along one edge and covers the opening in the duct connector when in the closed position. To form the hinge, the damper flap is fastened along one edge to a rod that is mounted in spaced holes in the duct connector. Or, sleeves may be formed along an edge of the plate. Each sleeve receives one end of a pin inserted through the duct connector. The pins can be secured to the flap or duct connector to mount the flap in the connector.

However, damper flap and duct connector units of the above types are time consuming and expensive to fabricate and assemble, thereby increasing the cost of this component of the ventilator.

SUMMARY OF THE INVENTION

It is the object of the present invention to provide an improved damper flap and duct connector assembly for ventilators and the like that can be fabricated and assembled in a simple and facile manner, thereby to lend economy to the assembly.

Specifically, the damper flap used in the assembly of the present invention is formed such that the flap may be pivotably attached to a duct connector without any pins or other securing means being necessary to hold the flap in pivotable connection with the duct connector. The flap is thus of "one piece" construction. Furthermore, the duct connector used in the assembly can also be formed of a single piece of material, negating the need for a welded or other connection between separate portions of the connector.

Another object of this present invention is to provide such an improved damper flap assembly of the present invention that reliably prevents outside air from flowing inwardly through a ventilation system duct and into a room within a climate controlled building.

The improved damper flap and duct connector assembly comprises a duct connector attached over an outlet opening of a ventilator and a damper flap pivotably mounted to the duct connector.

The duct connector is formed of a single piece of a rigid material, such as metal, that includes a flat, circular panel attachable to the ventilator at a ventilator outlet opening. The panel includes an air flow opening that is aligned with the ventilator outlet opening to allow air flowing out of the ventilator to pass freely through the connector. The panel also includes a pair of spaced, opposed brackets located above the opening in the panel. The brackets each include a hole for pivotably securing the damper flap therein. A generally circular ring is integrally formed with the panel and extends perpendicularly from the edge of the panel. The ring provides a connection for the ventilation duct used to direct the air flow from the ventilator to the exterior of the building.

The damper flap, pivotably connected to the duct connector, comprises a generally flat plate formed of a resilient material, such as metal, that is capable of flexing. At one edge of the plate, a pair of arms extend outwardly from the plate. The arms may be formed by rolling spaced, outwardly extending edge portions of the flap toward the plate to form the arms as mounting tubular members integral with the rectangular plate.

To assemble the damper flap and duct connector, the damper flap is flexed to a curved form along a center line of the plate normal to the direction of extension of the arms. The plate is pivotably secured to the duct connector by placing each of the arms into an opening in the spaced brackets on the panel of the duct connector. With the damper flap flexed, the length between opposite ends of the arms is less than the spacing between the brackets, so this may be easily accomplished. The plate is then released to the flat form so that the length between the ends of the arms expands. This retains the arms in the holes in the brackets and then damper flap over the duct connector.

When the ventilator is operated, the arms on the damper flap pivot in the holes in the brackets so that the damper flap swings to the open position to allow air to be discharged from the ventilator. When the ventilator is not operated, the damper flap lies across the opening in the duct connector to prevent backdrafts.

DETAILED DESCRIPTION OF THE INVENTION

Figure 1:
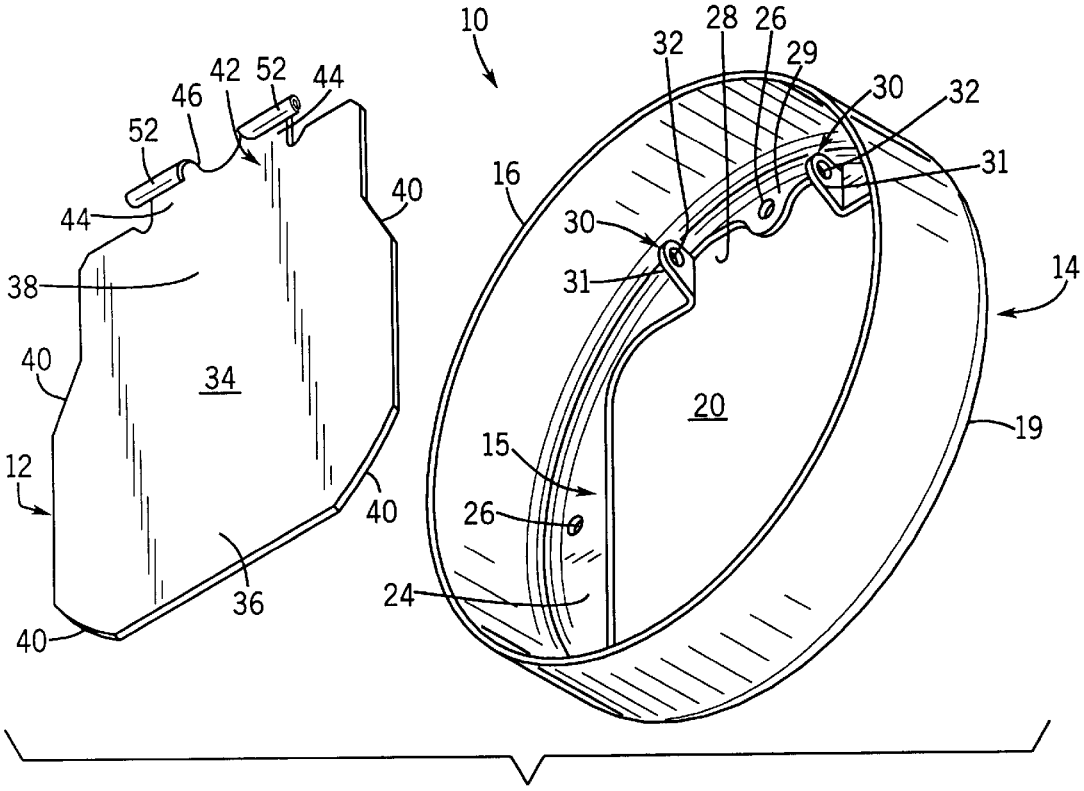
FIG. 1 is an exploded, perspective view of a damper flap and a duct connector used to form the damper flap assembly constructed according to the present invention.
Figure 2:
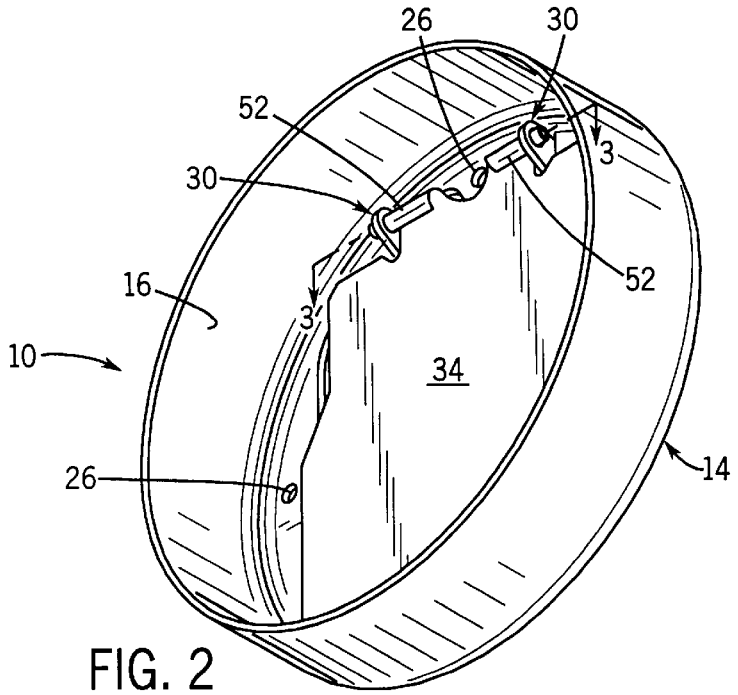
FIG. 2 is a perspective view of the assembled damper flap assembly of FIG. 1 in the closed position.

With reference now to the drawing figures in which like reference numerals designate like parts throughout the disclosure, FIG. 1 shows a damper flap assembly indicated generally at 10 for use within a ventilation system to restrict air flow through ventilation ducts in a single direction. Assembly 10 generally comprises damper flap 12 pivotably mounted to duct connector 14.

The duct connector 14 may be formed in a conventional stamping process from a single piece of metal, such as galvanized steel, and includes a cylindrical ring portion 16 extending perpendicularly from an outer edge 19 of a generally circular panel portion 18. The panel portion 18 is placed against the exterior surface of a ventilator (not shown) to surround an outlet opening (not shown) for the ventilator.

The panel portion 18 includes a generally rectangular air flow opening 20 that is aligned with the ventilator outlet to allow air flowing through the ventilator outlet opening to enter the connector 14. The opening 20 is located generally in the center of panel portion 18.

A plurality of small, arc-shaped sections 24 adjacent opening 20 have mounting holes 26. Each hole 26 receives a threaded fastener (not shown) that secures the duct connector 14 to the ventilator about the ventilator outlet opening.

Cutout 28 extends outwardly from an edge of the opening 20 toward the outer edge 19 of the panel portion 18. Cutout 28 defines a small, bell curve shaped extension 29 that extends inwardly from the outer edge 19 of panel portion 18 and includes a mounting hole 26. The edges of cutout 28 are bent perpendicularly to the panel portion 18 to form a pair of spaced, opposed brackets 30 that are integral with panel portion 18. Each bracket 30 includes a rounded outer edge 31 and a flap mounting hole 32. As hereinafter described, mounting holes 32 contained within the brackets 30 are used to pivotably connect the damper flap 12 to the duct connector 14.

The flap 12 is formed of a plate configured to cover air flow opening 20. In the embodiment shown in the Figures, opening 20 is generally rectangular and plate 34 is similarly rectangular. Plate 34 includes a wide, lower portion 36 and a narrow, upper portion 38. Lower portion 36 has a width greater than opening 20 in panel portion 18 and includes angled edges 40 located in its corners. Upper portion 38 includes an appendage 42 extending from upper portion 38. The appendage 42 includes a pair of tabs or arms 44 that extend outwardly from the appendage and are separated by a generally U-shaped notch 46 extending into the appendage 42. Arms 44 are each formed by rolling the upper edge of plate 34 towards the plate to form a pair of outwardly extending tubes 52 on either side of the notch 46 as shown in FIG. 1.

Figure 3A:
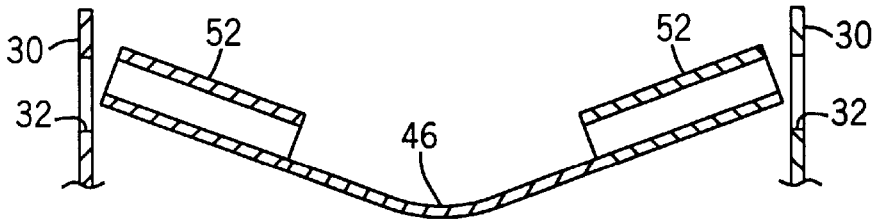
FIG. 3A is a cross-sectional view along line 3—3 of FIG. 1 showing the damper flap in a flexed position disengaged from the duct connector.
Figure 3B:
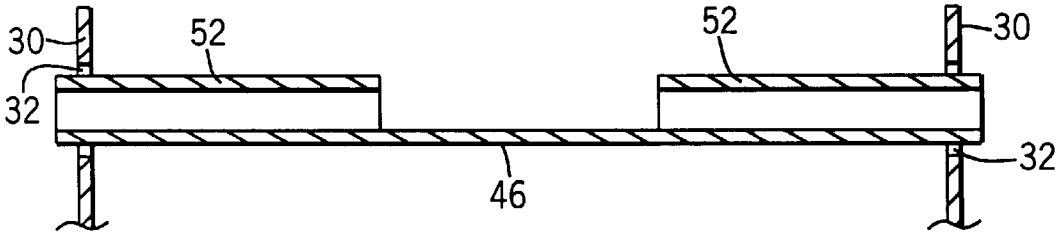
FIG. 3B is a cross-sectional view of the damper flap in an unflexed position engaged with the duct connector.

To assemble flap 12 to duct connector 14, flap 12 is flexed in the central portion as shown in FIG. 3A so that the tubes 52 may be inserted into the mounting holes 32 in the brackets 30. The flexing of flap 12 may be accomplished by grasping the opposite edges of plate 34 and squeezing them in a direction toward each other. When tubes 52 have been inserted into brackets 30, plate 34 is released and allowed to snap back into its flat condition. In this condition, the length between opposite ends of the tubes 52 is greater than the length between the facing brackets 30, as shown in FIG. 3B. Therefore, each tube 52 extends through a bracket 30 a sufficient distance to prevent the tubes 52 from disengaging from the bracket 30 thereby to retain flap 12 in connector 14. The tubular nature of tubes 52 facilitates the pivotal movement of flap 12 in round holes 32.

While tubes 52 have been shown and described as extending from the upper edge of flap 12, they may extend from other locations on the flap and into correspondingly located mating brackets in connector 14, if desired.

The assembly 10 may then be attached to the ventilator by placing the assembly 10 over the ventilator outlet opening and inserting threaded fasteners through the mounting holes 26 in plate portion 18 into the exterior of the ventilator housing.

In operation, the air flow from the ventilator contacts the flap 12 and pivots it upwardly away from the opening 20 in plate portion 18, allowing the air to pass through the assembly 10. As the pivot point formed by the brackets 30 and the tubes 52 for the flap 12 on the connector 14 is above the air flow opening 20, the amounts of noise and interference to the air flow caused by the flap 12 are greatly reduced.

When the ventilator is not in operation, the lower portion 36 of flap 12 rests against the arc-shaped portions 24 and prevents outside air from passing through the connector 14 and into the ventilator.

What is claimed is:

1. An improved damper flap and duct connector assembly comprising:

a duct connector with an air flow opening, said duct connector having a pair of opposing brackets spaced from each other by a predetermined length, the brackets each including mounting hole; and a damper flap including a pair of arms extending outwardly from said flap, the length between outer ends of said arms being greater than said predetermined length, said arms comprising portions of said flap spaced from one another that are rolled inwardly to form tubes that are pivotably retained within the holes in the opposing brackets, said damper flap having a portion intermediate said arms that can be flexed to reduce the length between said arms to less than said predetermined distance to allow said arms to be inserted in the holes in said opposing brackets.

2. The damper flap of claim 1 wherein the tubes are separated by a notch disposed between the arms.

3. The damper flap of claim 1 wherein the arms extend from an edge of a generally flat plate that forms the flap.

4. An improved damper flap for use with a duct connector in a ventilation system comprising:

a generally flat plate, the plate having a pair of arms extending outwardly from the plate and spaced from one another, the arms being rolled inwardly to form a pair of integrally attached tubes on the flap for pivotally connecting the damper flap to the duct connector, said plate also having a portion intermediate said arms that can be flexed to reduce a length dimension extending between outer ends of the arms.

5. The damper flap of claim 4 wherein the arms are separated by a notch in said intermediate, flexible portion.

6. The damper flap of claim 5 wherein the notch is generally U-shaped.

7. The damper flap of claim 4 wherein the arms are located adjacent a top edge of the flap.

8. In a damper flap and duct connector assembly, the assembly having a duct connector including a flat, generally circular panel, the panel having an air flow opening and a pair of facing brackets disposed above the opening and extending outwardly from the panel, and having a cylindrical ring attached about the periphery of the panel and extending generally parallel to the brackets, and the assembly having a damper flap formed of a resilient material having a width generally greater than the air flow opening and pivotably mounted between the brackets, the improvement comprising:

a pair of arms extending outwardly from the damper flap that are rolled inwardly to form a pair of mounting tubes insertable into the brackets to pivotably mount the flap on the connector.

9. The improvement of claim 8 wherein the panel and ring of the connector are unitarily formed.

10. The improvement of claim 9 wherein the material forming the flap and the connector is galvanized steel.

* * * * *